US005306884A

United States Patent [19]

Caserta et al.

[11] Patent Number: 5,306,884

[45] Date of Patent: Apr. 26, 1994

[54] IMPACT RESISTANT SWITCH KNOB

[75] Inventors: Joseph N. Caserta; Gary M. Vance, both of Roanoke, Va.

[73] Assignee: ITT Corporation, New York, N.Y.

[21] Appl. No.: 998,823

[22] Filed: Dec. 30, 1992

[51] Int. Cl.[5] ..... H01H 3/20

[52] U.S. Cl. ..... 200/330; 200/537; 200/538; 200/345

[58] Field of Search ..... 200/330, 577, 538, 342, 200/520, 334, 345, 539, 540, 541, 542, 332, 333, 338; 74/503

[56] References Cited

U.S. PATENT DOCUMENTS 1,629,896 5/1927 Valerius ..... 200/540
3,624,330 11/1971 Bognar ..... 200/342
4,965,420 10/1990 Phillips et al. ..... 200/342
5,201,409 4/1993 Martin et al. ..... 200/296

*Primary Examiner*—Henry J. Recla
*Assistant Examiner*—David J. Walczak
*Attorney, Agent, or Firm*—Patrick M. Hogan

[57] ABSTRACT

The present invention is a knob which attaches to the switch post of a push/pull switch. The knob selectively disengages from the switch post as the knob is inadvertently impacted, thereby isolating the push/pull switch from the impacting force. The knob moves independently of the switch post and contacts the housing supporting the switch. Consequently, the force of impact is directed to the housing through the body of the knob and very little force is directed to the switch.

11 Claims, 2 Drawing Sheets

IMPACT RESISTANT SWITCH KNOB

FIELD OF THE INVENTION

The present invention relates to knobs for electrical switches, and more particularly to such knobs that transfer the force of an impact to the housing of the device supporting the switch, rather than to the switch itself.

BACKGROUND OF THE INVENTION

Push/pull switches are electrical switches that operate by being pushed inwardly or pulled outwardly along a central axis. Such push/pull switches are commonly used to turn power on and off in a variety of devices such as radios, televisions, computer monitors and the like. Many such push/pull switches also have secondary control functions governed by the rotation of the switch knob around its central axis. For example, such a knob may be pulled outwardly to provide power to a television, pushed in to turn off the television, and rotated around its central axis to control a desired parameter such as the volume of the television.

Since push/pull switches must be pushed, pulled, turned and otherwise manipulated by an operator, such switches typically have large knobs. The large knobs promote the engagement of the switch by an operator's fingers, thereby making the switch easy to locate and operate. When push/pull switches are used on portable devices, the large size of the knob produces disadvantages. Portable devices experience many impacting forces as the device is carried or set into position for use. Since the knobs of push/pull switches are relatively large, many of the impact forces incurred act directly upon the knob of the switch. With many prior art switches, forces that impact the knob are directly transferred to the components of the switch. Consequently, the switches often break rendering the overall device inoperative until the switch can be replaced or repaired.

It is therefore an object of the present invention to provide a knob for a push/pull switch that does not transfer the forces of impact to the components of the switch, thereby increasing the overall reliability and resistance to shock of the device containing the switch.

SUMMARY

The present invention is a knob for a push/pull switch of the kind used in a PVS-7 night vision goggle assembly. In such an assembly, the push/pull switch extends out of an external surface of the goggle assembly housing, where it is held in place by a locking nut. The push/pull switch operates by the linear reciprocal movement of a post, which extends out of the push/pull switch on the exterior of the goggle assembly. The present invention knob attaches to the post of the push-/pull switch, thereby allowing the switch to be operated by the linear reciprocal movement of the knob. The post of the push/pull switch passes through a central elongated cavity formed within the knob. The switch post is held within the knob by a pin that passes through both the knob and the switch post. An elongated slot is formed within the knob through which the pin passes and engages the switch post. The elongated slot is larger than the diameter of the pin, consequently, the knob is free to reciprocally move independently of the switch post until the pin extending from the switch post engages the surface of the elongated slot. Once the pin contacts the elongated slot, the knob and switch post are positively coupled and the switch post moves with the knob. To prevent rattling, a spring is positioned within the knob that biases the knob against the pin.

A cavity is formed at one end of the knob that is large enough to surround the locking nut that retains the push/pull switch in place. If the knob is inadvertently impacted and driven against the goggle housing, the knob contacts the goggle housing around the locking nut. As such, the force of the impact is directed to the goggle housing through the body of the knob. Additionally, as the knob is driven against the goggle housing, the knob disengages the switch post. Consequently, the switch post does not absorb any energy from the inadvertent impact from the knob.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention switch knob can be used in many different applications where an electrical push/pull switch may incur impact forces, it is especially suitable for use with portable military equipment which is carried or worn by military personnel. Such military equipment has a high degree of physical abuse in a wide variety of environments which increase the occurrences of forces impacting the switch knob. Accordingly, a prior art switch knob and the present invention switch knob will be described and compared in connection with a PVS-7 night vision goggle assembly which is currently used in the miliary and is manufactured by ITT Corporation, the assignee herein.

Before further explanation and in order to clarify the subject matter it is indicated that the switch utilized in the PVS-7 night vision goggle assembly is not a true push/pull switch but is a three position switch. It has one pull function and that is to place the switch to a position three. In any event, the switch is an ordinary on/off switch as a rotatable switch where position one is the OFF position, position two is an ON position which biases the goggle on. In order to operate the switch from position one to position two the switch is turned or conventionally rotated in the clock wise or counter clock wise direction. Position three requires a push/pull operation in the sense that if the operator wishes the goggles to be on and infrared (IR) light to be on, then he pulls the switch to enable the switch in position three. In position three, the goggles and the infrared light are both on. In any event, this must be a very deliberate action as the operator or user does not want to go into position three accidentally because in this position he becomes a visible target. In any event, it is this push/pull operation that the present invention attempts to solve. The following discussion relates to the push/pull operation as described above and essentially will be referred to an on/off operation. It is, of course, understood that the mechanism to be described herein will operate with any type of switch having a knob whereby the knob is pulled out or pushed in to either exhibit a different position operation or to exhibit an on/off operation.

Figure 1:
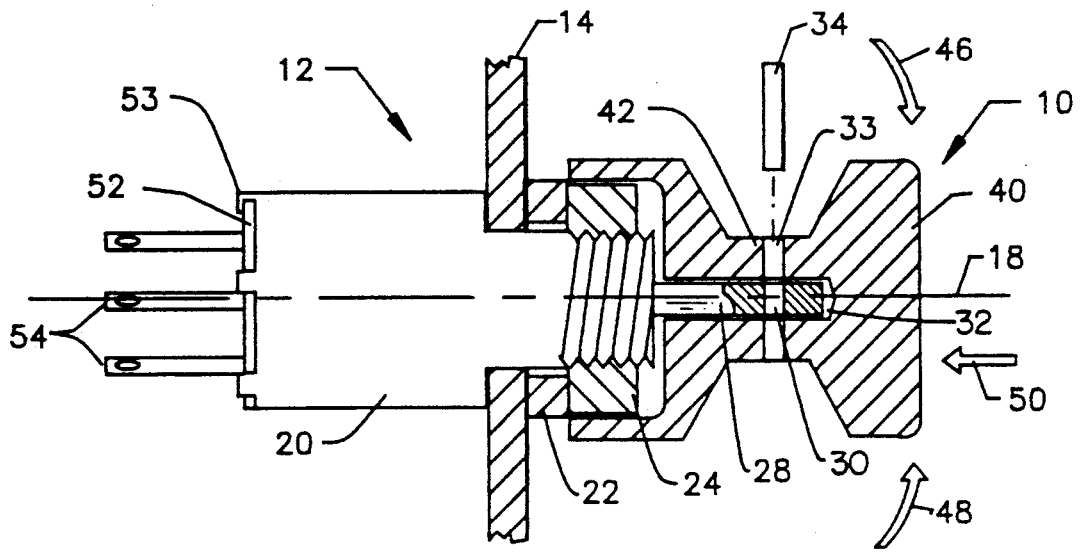
FIG. 1, shows a cross-sectional view of a prior art switch knob in conjunction with a selectively cross-sectioned push/pull switch for a PVS-7 night vision goggle assembly to facilitate consideration and discussion.

Referring to FIG. 1 there is shown a prior art switch knob 10 for an electrical push/pull switch 12 conventionally used on a PVS-7 night vision goggle assembly. The switch 12 extends through, and is attached to, the housing 14 of the PVS-7 night vision goggle assembly. The switch 12 is operated by moving the switch knob 10 back and forth along the mid-axis 18 of the switch and turning the switch knob 10 around the mid-axis 18. In the embodiment of FIG. 1, the switch 12 is shown in an off position wherein the switch knob 10 is depressed toward the goggle housing 14. To turn the switch 12 on, the switch knob 10 would be pulled away from the goggle housing 14 along the mid-axis 18. Finally, to adjust the PVS-7 goggle assembly, the switch knob 10 can be rotated around the mid-axis 18.

As can be seen, the housing 20 of the switch 12 is firmly attached to the goggle housing 14 through the use of a washer 22 and a locking nut 24. The operation of the switch 12 is controlled by the manipulation of a control post 28 which extends from the switch 12 beyond the housing 20. An aperture 30 is formed through the control post 28, proximate its distal end. The aperture 30 is generally circular in configuration. The control post 28 extends into an elongated cavity 32 which is centrally formed within the switch knob 10. An orifice 33 is formed through the switch knob 10 intersecting the elongated cavity 32 at a perpendicular. The aperture 30 of the control post 28 aligns with the orifice 33 of the switch knob 10, creating a continuous open pathway into which a locking pin 34 can be press fit. The presence of the locking pin 34 disposed between both the switch knob 10 and the control post 28 prevents the independent movement of the switch knob 10 relative the control post 28.

The switch knob 10 itself is essentially T-shaped having an enlarged head 40 and a narrow stem 42 to promote easy manipulation by an operator's fingers. Although the enlarged head 40 makes the switch knob 10 easy to manipulate, it also leaves the switch knob 10 highly vulnerable to impact. Forces that impact the switch knob 10 are directly transferred to the control post 28, since the switch knob 10 and control post 28 are bound together by the locking pin 34. Impact forces that attempt to displace the switch knob 10 from its mix-axis 18, as indicated by arrows 46 and 48, act to bend the control post 28. Such forces may sever or bend the control post 28, thereby preventing the control post 28 from moving back and forth within the switch 12.

An impact force that drives the switch knob 10 toward the goggle housing 14, as indicated by arrow 50, is also transferred directly to the control post 28. The control post 28 directs the force of impact directly into the switch 12 where it is experienced by the internal components of the switch 12. In a conventional prior art switch 12, a plastic insulator 52 is positioned at the far end of the switch 12, where it separates and supports the various pin connectors 54 that lead to the switch 12. The housing 20 of the switch 12 is rolled over the plastic insulator at places, thereby retaining the plastic insulator 52 and the components it supports into place. As an impact force is transferred into the switch 12 along the control post 28, the impact forces are passed through the various components of the switch 12 until the force is absorbed by the plastic insulator 52. The absorbed force acts to unroll the housing roll over crimps 53 that retain the plastic insulator 52 in place. Consequently, the force of impact may displace the plastic insulator 52 and cause the switch 12 to disassemble and become inoperative.

Figure 2:
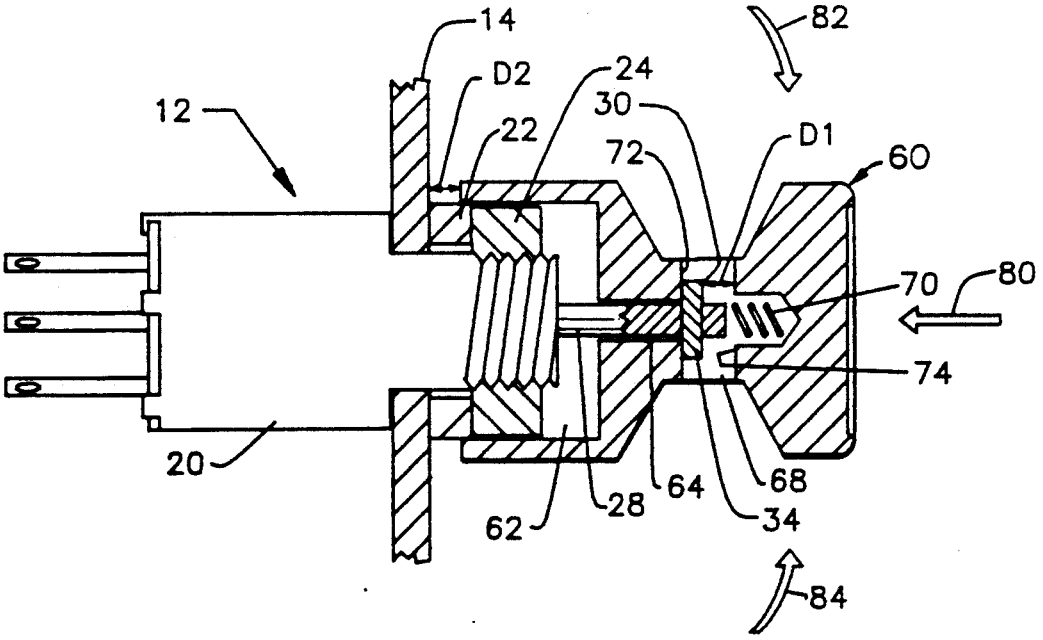
FIG. 2, shows a cross-sectional view of one preferred embodiment of the present invention switch knob in conjunction with the selectively cross-sectioned push-/pull switch and PVS-7 night vision goggle assembly of FIG. 1.

Referring to FIG. 2, there is shown one preferred embodiment of the present invention switch knob 60 shown in conjunction with the same switch 12 and goggle housing 14 as was discussed above in regard to FIG. 1. As such, the nomenclature regarding the switch 12 and goggle housing 14 used in FIG. 1 will be preserved in the description of FIG. 2.

In FIG. 2, the switch knob 60 has an enlarged bottom defining a cylindrical cavity 62. The diameter of the cylindrical cavity 62 is slightly larger than the diameter of the washer 22 and locking nut 24 used to retain the switch 12 against the goggle housing 14. The depth of the cylindrical cavity 62 is also deeper than the combined width of the locking nut 24 and washer 22. As such, the cylindrical cavity 62 can pass over both the locking nut 24 and the washer 22 and can engage the surface of the goggle housing 14 directly in the area surrounding the locking nut 24 and washer 22.

An elongated cavity 64 is coaxially formed within the switch knob 60, intersecting the center of the cylindrical cavity 62. The elongated cavity 64 terminates at a point within the switch knob 60. A slot aperture 68 passes through the switch knob 60 from one side to the other, wherein the slot aperture 68 intersects the elongated cavity 64 at a perpendicular. The control post 28 of the switch 12 extends into the elongated cavity 64 through the cylindrical cavity 62. A spring 70 is disposed within the elongated cavity 64 and is compressed by the control post 28 as the control post 28 is advanced into the elongated cavity 64. The aperture 30 directed through the control post 28 is aligned with the slot aperture 68 formed through the switch knob 60, providing a continuous aperture through both the switch knob 60 and control post 28. A locking pin 34 is inserted through the slot aperture 68 in the switch knob 60 and is press fit into the aperture 30 in the control post 28. The press fit of the locking pin 34 in the aperture 30 retains the locking pin 34 in a set position relative the control post 28. The diameter of the locking pin 34 is smaller than the length and width of the slot aperture 68. As a result, the switch knob 60 can move independently of the locking pin 34 and the control post 28 until the locking pin 34 contacts an edge of the surrounding slot aperture 68.

The spring 70 biases the switch knob 60 away from the switch 12. As a result, the locking pin 34 depending from the control post 28 is biased against a first end 72 of the slot aperture 68. Consequently, a space having a distance D1 exists within the slot aperture 68 in between the locking pin 34 and second end 74 of the slot aperture 68. The bias created by the spring 70, between the control post 28 and the switch knob 60 also acts to bias the switch knob 60 away from the goggle housing 14 by a distance D2. The spring 70 keeps the switch knob 60 biased into this set position relative the switch 12. As such, the switch knob 60 is not unrestrained and cannot move independently of the switch 12 unless the switch knob 60 is positively engaged in opposition of the spring bias.

The distance D2, separating the switch knob 60 from the goggle housing 14 is less than the distance D1 separating the locking pin 34 from the second surface 74 within the slot aperture 68. As such, when the switch knob 60 is impacted with downward force, as indicated by arrow 80, the switch knob 60 compresses the spring 70 and moves in the direction of arrow 80. Since the distance D2 separating the switch knob 60 from the goggle housing 14 is less than the distance D1 separating the locking pin 34 from the second surface 74 within the slot aperture 68, the switch knob 60 contacts the goggle housing 14 before the locking pin 34 contacts the second surface 74 of the slot aperture 68. Consequently, the force of the impact is transferred through the body of the switch knob 60 directly to the surface of the goggle housing 14. There is a great reduction of the force of impact experienced directly by the switch 12 which is mainly the force exerted by the spring 70. The force of the spring 70 against the control post 28 of the switch 12 is not enough to damage the switch 12. As such, the force of impact is absorbed by the goggle housing 14 and the switch 12 remains generally unaffected by the impact. Since the switch 12 does not experience a great force of impact, the present invention switch knob 60 provides more protection to the switch 12 than is available in the prior art, thereby adding to the reliability and durability of the overall device.

The cylindrical cavity 62 formed within the switch knob 60 has a diameter that allows it to revolve around the washer 22 and locking nut 24 that retain the switch 12 against the goggle housing 14. If the switch knob 60 is impacted by a side ways force, such as is indicated by arrows 82, 84, the impacting force acts to bend the switch knob 60 from its original coaxial position with the control post 28 of the switch 12. Since the cylindrical cavity 62 in the switch knob 60 is only slightly larger than the locking nut 24 and the washer 22 it surrounds, the switch knob 60 contacts the locking nut 24 and washer 22 when impacted with a sideways force. The contact between the switch knob 60, with the locking nut 24 and washer 22, limits the distance in which the switch knob 60 can laterally move. The amount of lateral movement permitted the switch knob 60 is well within the elastic range of the control post 28 of the switch 12. Consequently, the lateral movement of the switch knob 60 by the contact within the cylindrical cavity 62 is not great enough to damage the control post 28.

In the shown embodiment of FIG. 2, the diameter of the elongated cavity 64 within the switch knob 60 is larger that the diameter of the control post 28 of the switch 12. As such, the switch knob 60 can move laterally for a limited range without contacting the control post 28 of the switch 12. This assures that the lateral movement of the switch knob 60 does not act to damage the control post 28 of the switch 12.

Figure 3:
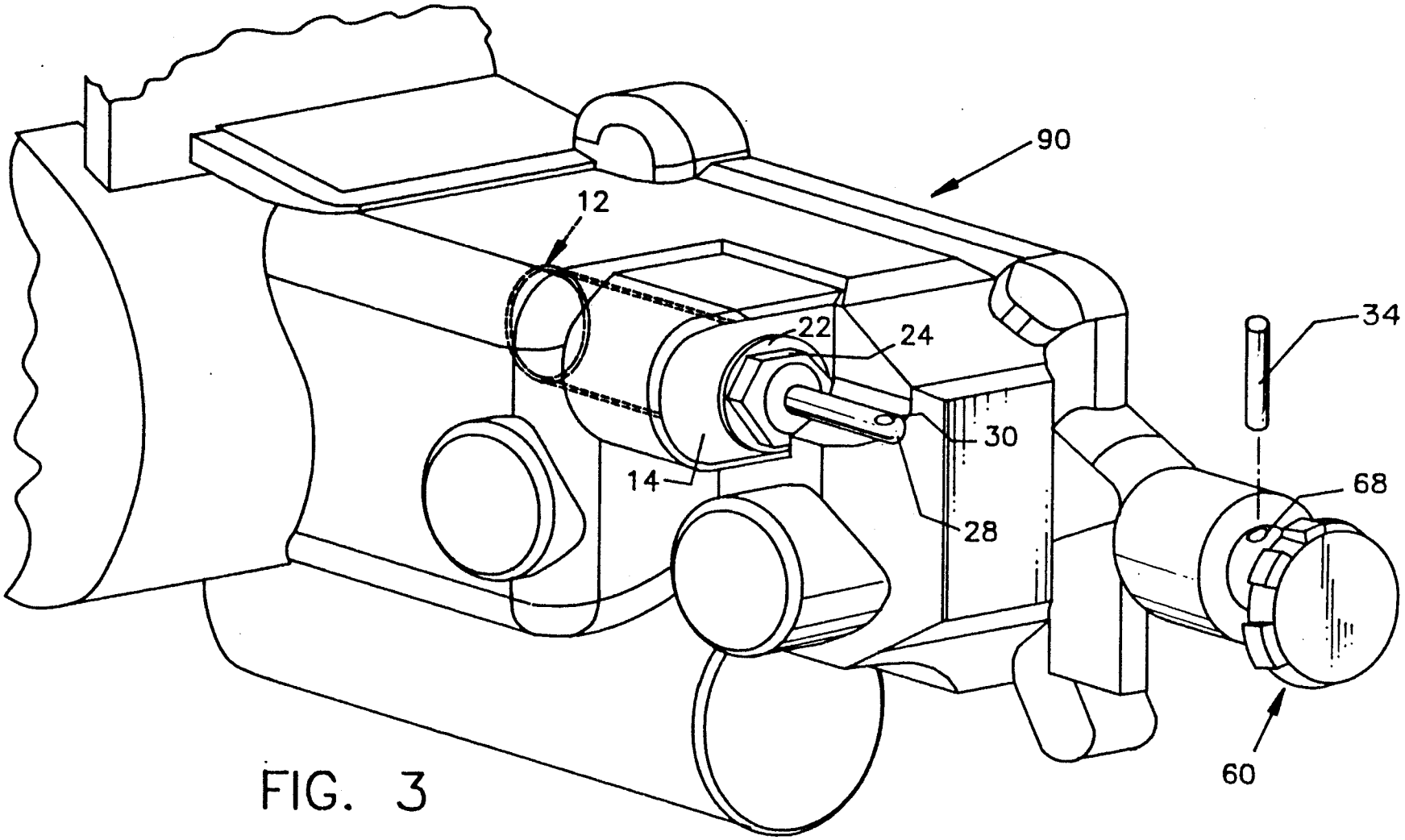
FIG. 3, shows a perspective view of the embodiment of FIG. 2 to facilitate consideration and discussion.

Referring to FIG. 3, the present invention switch knob 60 is shown in conjunction with a segment of a PVS-7 night vision goggle assembly 90, in which is included a push/pull switch 12 of the type previously described. In prior art PVS-7 goggle assemblies a five inch drop to a hard surface would provide enough force to damage the push/pull switch and render the switch operable. In the present invention, any force of impact is no longer transferred to the switch 12, but rather is absorbed directly by the segment of the PVS-7 goggle assembly 90 supporting the switch 12. As applied to the PVS-7 goggle assembly 90 shown, the present invention switch knob 60 greatly increases the resistance of the switch 12 to shock, thereby resulting in a much more reliable and rugged assembly.

It will be understood that the embodiment of the present invention described herein is merely exemplary and that a person skilled in the art may make many variations and modifications to the invention other than is specifically described. More specifically, it should be understood that the present invention knob need not be limited in its application to a PVS-7 night vision goggle assembly, but may be used in any application having a push/pull switch which is vulnerable to impact. All such variations and modifications are intended to be included within the scope of this invention as defined by the appended claims.

What is claimed is:

1. In an apparatus having a push/pull switch extending through one external surface thereof, said push/pull switch being operative by the reciprocal linear movement of a post from a first position to a second position, a knob device for manipulating said post, comprising:

an engagement means for selectively engaging said post, whereby said post can be moved between said first position and said second position by the reciprocal manipulation of said knob;

a separating means for selectively disengaging said post as said knob is advanced toward said external surface, said separating means enabling said knob to move independently of said post within a predetermined range, whereby said knob disengages from said post and contacts said external surface when said post is said first position and said knob is advanced toward said external surface.

2. The knob according to claim 1, further including a biasing means for biasing said knob into a set position relative said post, wherein said knob positively engages said post at said set position.

3. The knob according to claim 1, wherein said post linearly moves from said first position to said second position along an axis and wherein said knob further includes a limiting means for limiting lateral movement of said knob from said axis.

4. The knob according to claim 3, wherein said push/pull switch is attached to said external surface by a locking nut and said knob includes a cavity disposed at one end of said knob, said locking nut passing into said cavity as said knob is advanced toward said external surface, whereby said knob contacts said external surface around said locking nut.

5. The knob according to claim 4, wherein an elongated aperture is disposed within said cavity through which said post is passed, and a pin member is disposed through said knob and said post in said elongated aperture, thereby preventing the removal of said post from said elongated aperture.

6. The knob according to claim 5, wherein a slot is disposed within said knob, intersecting said elongated aperture, said slot having first end proximate said cavity and a second end distal said cavity, wherein said pin member extends into said slot, said pin member engaging said first end of said slot as said knob is moved relative said post away from said external surface and said pin member engaging said second end of said slot as said knob is moved relative said post toward said external surface, whereby said predetermined range said knob can move independently of said post is determined by the size of said slot.

7. The knob according to claim 6, wherein said elongated aperture is wider than said post, thereby enabling said knob to move laterally across a given range without engaging said post.

8. The knob according to claim 6, wherein a bias means biases said first end of said slot against said pin member.

9. The knob according to claim 8, wherein said bias means includes a spring disposed within said elongated aperture, said spring biasing said post out of said elongated aperture.

10. The knob according to claim 4, wherein said cavity surrounds said locking nut as said knob contacts said external surface, said locking nut contacting said knob within said cavity, preventing lateral movement of said knob from said axis of said post.

11. The knob according to claim 1, wherein said apparatus containing said push/pull switch is a PVS-7 night vision goggle assembly.

* * * * *